US006234537B1

(12) United States Patent
Gutmann et al.

(10) Patent No.: US 6,234,537 B1
(45) Date of Patent: May 22, 2001

(54) SECURITY DOCUMENT WITH OPTICALLY EXCITABLE DYES FOR AUTHENTICITY CHECK

(75) Inventors: Roland Gutmann; Benedikt Ahlers; Frank Kappe; Ralf Paugstadt; Arnim Franz-Burgholz, all of Berlin (DE)

(73) Assignee: Bundesdruckerei GmbH, Berlin (DE)

( * ) Notice: Subject to any disclaimer, the term of this patent is extended or adjusted under 35 U.S.C. 154(b) by 0 days.

(21) Appl. No.: 09/374,882

(22) Filed: Aug. 13, 1999

(30) Foreign Application Priority Data

Aug. 14, 1998 (DE) ..... 198 36 813

(51) Int. Cl.[7] ..... B42D 15/00
(52) U.S. Cl. ..... 283/86; 283/91
(58) Field of Search ..... 283/86, 87, 88, 283/89, 90, 91, 92, 93, 95, 114

(56) References Cited

U.S. PATENT DOCUMENTS

| | | | | |
|---|---|---|---|---|
| 4,442,170 | | 4/1984 | Kaule et al. | 428/333 |
| 4,451,521 | | 5/1984 | Kaule et al. | 428/199 |
| 4,533,244 | | 8/1985 | Kaule et al. | 356/71 |
| 4,598,205 | * | 7/1986 | Kaule et al. | 250/458.1 |
| 4,678,322 | | 7/1987 | Finkel et al. | 355/133 |
| 4,738,901 | | 4/1988 | Finkel et al. | 428/690 |
| 5,093,147 | | 3/1992 | Andrus et al. | 427/7 |
| 5,399,499 | | 3/1995 | Paz-Pujalt et al. | 436/165 |
| 5,439,616 | | 8/1995 | Ishiwata et al. | 252/584 |
| 5,448,582 | | 9/1995 | Lawandy | 372/42 |
| 5,492,776 | | 2/1996 | Paz-Pujalt et al. | 428/696 |
| 5,625,456 | | 4/1997 | Lawandy | 356/376 |
| 5,684,621 | | 11/1997 | Downing | 359/326 |
| 5,684,815 | | 11/1997 | Miura et al. | 372/40 |
| 5,744,233 | | 4/1998 | Opitz et al. | 428/328 |

FOREIGN PATENT DOCUMENTS

| | | | |
|---|---|---|---|
| 31 21 484 A1 | 4/1982 | (DE) | B44F/1/12 |
| 31 21 523 A1 | 4/1982 | (DE) | B44F/1/12 |
| 41 14 732 A1 | 11/1992 | (DE) | B44F/1/12 |
| 44 32 035 A1 | 3/1996 | (DE) | C09K/11/02 |
| 197 01 513 A1 | 7/1998 | (DE) | G07D/7/00 |
| 197 08 543 A1 | 9/1998 | (DE) | B44F/1/12 |
| 0 667 556 A1 | 8/1995 | (EP) | G02F/2/02 |
| WO 90/06539 | 6/1990 | (WO) . | |

OTHER PUBLICATIONS

Press Release: "Smallest Dye Laser of Eight Millimeters," Sabine Gerbaulet, Nov. 25, 1998.

U. Vietze, et al., Darmstadt University of Technology, University of Frankfurt, and IMM, "Zeolite–dye micro lasers", Jul. 27, 1998.

* cited by examiner

*Primary Examiner*—Willmon Fridie, Jr.
(74) *Attorney, Agent, or Firm*—Darby & Darby

(57) ABSTRACT

A security document with optically excitable dyes for authenticity checking. Dyes are applied to or embedded in the security documents. The dyes are advantageously embedded in a carrier material which in conjunction with the dyes forms a laser-active element. Certain optically excitable dyes are incorporated in a security document in such a way that when the security and/or sensitive document is optically excited, the dyes embedded in the security and/or sensitive document resonate with the material of the securities and secure documents, so that a well-defined narrow spectrum of all excited materials is emitted.

12 Claims, 5 Drawing Sheets

SECURITY DOCUMENT WITH OPTICALLY EXCITABLE DYES FOR AUTHENTICITY CHECK

BACKGROUND OF THE INVENTION

1. Field of the Invention

The present invention relates to security documents, such as monetary, security or value related documents, wherein the dyes are applied to or embedded in the security document.

2. Description of the Related Art

The invention is based on a technology similar to that described, for example, in U.S. Pat. No. 4,738,901. In this references, a document has phosphor particles embedded therein as protection against copying. Copy protection is enabled, because the laser associated with the copier excites the phosphor particles and the radiation emitted by the phosphor particles is received by a second detector which indicates to the copier that the documents are protected. However, this copy protection process cannot check the authenticity of a security and sensitive document.

SUMMARY OF THE INVENTION

The present invention is based on the fact that certain optically excitable dyes are incorporated in such a way that upon optical excitation of the security documents, the dyes embedded in the security document resonate with the material of the security document and thereby emit a well-defined sharp spectrum of all the excited materials.

It is an object of the present invention to provide an authenticity check of a security document with optically excitable dyes, wherein a predetermined emission spectrum of the optically excited monetary and security document can be captured and a characteristic spectrum for the monetary and security document can thereby be generated, which is characteristic of the dye embedded in the security document as well as for the material of the security documents itself.

This object is accomplished in that the dyes are embedded in a carrier material and in conjunction with the carrier material form a laser-active element.

Accordingly, a resonance is produced between the material of the security document and the dyes embedded therein, which results in a well-defined emission spectrum which depends, on one hand, on the material of the documents and, on the other hand, on the embedded dyes.

Specially developed laser dyes having preferably non-commercial excitation wavelengths (UV to IR) can be integrated with the securities and the sensitive products in different ways. In principle, the laser dyes can be incorporated in the substrate (for example, paper, plastic foils), into paper additives (for example, fibers, planchets), into printing ink and depending on the fabrication techniques, combined with other security features (for example, fluorescence, electroluminescence, up-conversion and phosphorescence pigments, metallized plastic strips, holograms). For example, depending on the application, a suitable UV-absorbing protective jacket is required before liquid dye molecules can be incorporated in a solid matrix (granulate material having a size in the $\mu$m to nm region), especially to protect the dyes from UV light, solvents, or other reagents. It may also be possible to incorporate the laser dyes directly in a coloring component (resins or pigments). In applications using cards and foils, the un-encapsulated or encapsulated dyes can be mixed directly into and affixed to the polymer matrix. Laser dye is referred to a fluorescent material with a high efficiency which can be excited by a laser beam, in any physical form, i.e., solid, liquid or gaseous.

Laser dyes have an advantage over fluorescent materials in that they produce sharp emission peaks with well-defined emission wavelengths across the entire fluorescence range of the laser dyes. According to the invention, the "sharp emission peaks can only be realized if the laser-excitable fluorescent materials are embedded in an optical resonator. Resonant excitation is required for producing the sharp emission peaks which are characteristic for the geometry as well as for the optical properties of the resonator and the fluorescent materials.

The laser dyes may not only be incorporated in a resonator, but may also be used without a resonator, in which case the emission intensities of the securities and secure documents may be reduced.

That emission intensity may be increased by inserting the laser dyes in a resonator. This requires that both sides of the polymer layers of the laser dyes are coated with metallic or dielectric layers having a greater index of refraction. This increases both the radiated intensity and the security, because the number of peaks and their respective position in the wavelengths range of the fluorescence can be adjusted through the geometry and the optical properties of the resonator. The width of the peaks can also be adjusted by changing the geometry.

According to a first embodiment, the dyes are introduced directly into a physical layer or printed layer of the securities and secure documents, wherein the reflecting and/or dielectric layers represent portions of the securities and secure documents. In this way, a laser-active element, i.e., a resonator, is formed which reacts in a unique fashion to excitation with laser light or another high-energy light source.

According to another embodiment, the laser-active element is not a part of the layer structure of the securities and secure documents. Instead, the laser active elements are produced separately from the security document in form of independent resonators and are only subsequently incorporated in or applied to the documents in form of pigments plates or spheres (generally called particles) having a diameter of, for example, several $\mu$m.

Such resonators for application in printed security products can be manufactured, for example, with thin film technology. After depositing the individual layers, i.e., at least one reflecting layer, one layer containing dyes and another reflecting layer, having a thickness in the $\mu$m range on a foil support, the composite layer is broken up into smaller pieces. The two-dimensional fragments, which are commonly called flakes or pigment platelets and have a thickness of 1–10 $\mu$m and a surface area$<20\times20\ \mu m^2$, can then be integrated according to their size in the respective printing inks (for example, inks for steel engraving, screen printing, offset, book printing) or in the paper and foil material of the security document.

Different resonators with different geometry produce a characteristic peak pattern (fingerprint) of the "mixture" which is difficult to duplicate. Aside from the non-commercial excitation wavelengths, the threshold energy (minimum energy for the excitation of a laser emission) can also be used as an additional security parameter for authenticating such security features. Laser dyes can be applied as a hidden or two-stage security feature that can be controlled with UV light, since all laser dyes exhibit a broad band UV fluorescence, as mentioned above.

In the following sections, the possibilities for incorporating laser dyes in different sections of securities and sensitive products will be described.

Base Material (Paper, Plastic Foils)

Polymer-bound laser dyes can be incorporated in the paper by either adding bound dyes directly to the mixture of raw material or by applying the dyes by screen printing after the paper has dried. The direct addition is economically disadvantageous, since large quantities have to be added to produce a sufficiently strong light emission intensity. A much smaller quantity is required when the laser dyes are applied to the paper later by screen printing. In addition, a watermark may also be formed. By using transparent, colorless laser dyes, "hidden watermarks" can be embedded in the paper. Hidden watermarks in color can be produced by using different laser dyes.

Unlike paper, where laser dyes can be directly embedded in or applied to the paper, in the case of card stock, a very thin plastic foil can be "doped" or imprinted with the laser dyes. By using a specific card structure, the foil that includes the laser dyes can be incorporated in the center portion of the laminate. In this way, the dyes are chemically and physically protected from the environment, such as UV light, while at the same time enhancing the security by closely coupling the laser dye with the polymer layer.

Paper Additives

The laser dyes can also be integrated through a combination with so-called additives, such as plastic threads, fibers or planchets. Partially metallized plastic threads are embedded in the security document during their manufacture in form of aperture threads. To enhance security, these aperture threads may also carry a micro-inscription. The micro-inscription can be formed chemically (by etching) or physically (by laser ablation). The exposed areas appear as an aperture or window. The connection to the laser dyes may again be coupled with the plastic phase. As mentioned above, the laser dyes can be easily integrated into the plastic matrix. Through excitation from above, below or from one side with a suitable laser light, the micro-inscription can radiate light, for example, blue light depending on the selected laser dye. Laser dyes can not only be incorporated in aperture threads, but also in fibers or planchets. In the case of fibers, the laser dyes can be introduced in the fiber material. If the fibers are hollow ($d_i$>10 $\mu$m), the fiber cavities can be filled, or the fibers can be enclosed (d<2 $\mu$m) with a polymer matrix that is doped with laser dyes. Planchets can be enclosed or doped in essentially the same way as fibers.

When such laser dyes are incorporated in plastic threads, glass fibers or other transparent fibers, in particular textile fibers, a laser resonator is advantageously formed. Suppose that a plastic thread having a finite length is provided with mirrors at both ends and excited with a laser. A resonance phenomenon is produced, i.e., the plastic thread itself operates as a laser since the excitation light causes a stimulated emission along the fiber. Like for platelets, as described above, the length of the fiber and the reflection at the fiber ends determines the peak position and the half width of the emission peak. It is actually not necessary to provide the end faces with mirrors, and end faces without mirrors are sufficient. In the latter case, however, the dye embedded in the plastic thread has to be sufficiently efficient. This result is not limited to plastic threads, and any other type of thread can be used. The invention is based on the general principle discussed above, i.e., embedding such laser-excitable dyes in the securities and secure documents, with the goal to produce an optical resonance resulting in sharp, narrow-band peaks.

The present invention is not limited to excitation with a laser, and other energetic optical excitation means, such as a flash lamps, sodium or high-pressure lamps and the like, can be used. In addition, a dyes can also be excited with luminescence diodes emitting in the visible and invisible wavelength range.

Printing Inks

The primary application of laser dyes with securities and sensitive products is their direct incorporation in a printing ink. Examples are inks for steel engraving, screen printing and offset (wet offset, dry offset and indirect letterpress printing) as well as inks for book printing (pagination) and other printing methods relevant for printing securities and sensitive documents. Each of these inks have to be individually adapted to provide a match between the printing ink and the laser dyes, which are added either in molecular form or as a solid matrix. If resonators are used, their form (typically platelets, but also spheres) and size are essential for an efficient transfer from the ink to the print medium. Whereas in steel engraving and screen printing applications, dye pigments with a size of up to 20 $\mu$m can be conveniently printed, the upper limit with offset printing is between 2 and 4 $\mu$m. The specific form (platelets or spheres) influences the production cost, the miscibility with the printing ink (ink block), the stability, the quantum yield, and the spectral distribution/line shape. Spherical shapes are easier to manufacture and are mechanically more stable. Disadvantages are their inferior machinability and smaller resonator efficiency. The manufacture of platelets is technically complex and expensive, but typically produces a higher quantum efficiency and well defined adjustable peak patterns. In addition, the geometry of the radiation emitted by platelets can be exploited to produce an anisotropic radiation pattern. This arrangement, in combination with the thin color coatings used in offset printing, produces a high emission intensity. In general, the optical effects weaken with decreasing layer thickness (steel engraving up to 20 $\mu$m, offset 1 to 4 $\mu$m). The dye solutions may conceivably be integrated directly as a color component of the printing ink. This would be possible, for example, with resin components (colophonium) of highly viscous steel engraving inks or by encapsulating the dye solutions together with existing inks or effect pigments. The printing inks themselves serve as a stabilizer for un-encapsulated laser dye solutions. With respect to the color coordination and the color effect, the inks which act as a carrier medium for the laser dyes, should preferably be transparent, and not opaque. It should be possible to incorporate the dissolved or bound laser dyes in the printing inks by adding the dyes directly to the ink mixture consisting of solvent, pigments and additives. Because of the strong effect, concentrations in the sub-% range are sufficient and should be viewed as an upper limit for economical reasons.

Combination with Other Security Features

The laser dyes can not only be incorporated in the starting materials, but can also be combined with other security features, such as hidden features for enhanced protection, as an excitation source for secondary effects, such as UV fluorescence or phosphorescence, as background illumination of holograms or other diffraction structures. The laser dyes can also augment information, where without laser excitation only a portion of the hidden information (for example, a lenticular structure) may be visible. The combination of laser dyes with fluorescence fibers, planchets and aperture threads has already been described above. Another interesting modification may be a combination with electroluminescent (EL) pigments. Encapsulation of inorganic EL-pigments with a polymer phase doped with a laser dye provides a security feature with different verification stages that is almost impossible to duplicate. Excitation with UV light would produce a mixed fluorescence consisting of portions from EL pigments and portions from laser dyes. Excitation with a suitable laser beam may only excite the laser dyes, since the electrical field of laser light from a pulsed laser beam may not be sufficient to excite the EL pigments. Excitation by an electric field, on the other hand, would cause the EL pigments to light up. Not only the individually effects should be considered, but also their interaction, since the simultaneous effect of different excitation sources affects the band structure of these materials and thereby the resulting optical effects.

The subject matter of the present invention is recited in the claims, both taken individually and in combination.

All information and features—either individually or in combination—disclosed in the description, including the summary, in particular the embodiments illustrated in the drawings, are considered essential for the invention, as far as they are novel.

Several embodiments of the invention will be discussed hereinafter with reference to the drawings. Additional essential features and advantages of the invention can be deduced from the drawings and the descriptions thereof.

The disclosed use for printing of a security document should not be considered as limiting. Other examples are the integration of laser dyes in plastic cards (identification card, EU driver's license, credit cards), identification papers and a bank notes.

Other objects and features of the present invention will become apparent from the following detailed description considered in conjunction with the accompanying drawings. It is to be understood, however, that the drawings are intended solely for purposes of illustration and not as a definition of the limits of the invention, for which reference should be made to the appended claims.

BRIEF DESCRIPTION OF THE DRAWINGS

In the drawings, wherein like reference numerals delineate similar elements throughout the several views.

DETAILED DESCRIPTION OF THE PRESENTLY PREFERRED EMBODIMENTS

Figure 1:
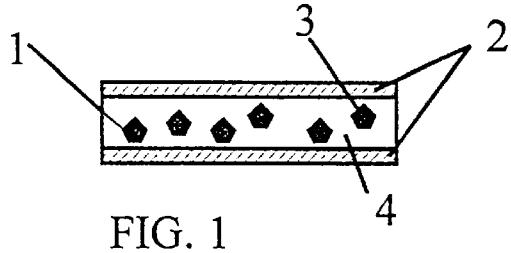
FIG. 1 schematically, is a basic structure of a pigment platelet which is embedded in a security document (not shown) or in a corresponding ink that is printed on or applied to the security document.

FIG. 1 illustrates in general a pigment platelet 1 consisting of two mutually parallel spaced-apart reflecting layers 2 which are applied on a polymer layer 4. The reflecting layers 2 consist of an oxide layer, for example, silicon oxide, silicon liquids, tin oxide, titanium oxide and the like, but may also be a metallic layer. It is essential, however, that two reflecting layers 2 oppose each other, in other words act as a mirror with respect to the interposed polymer layer, and that the laser dyes 3 are embedded in the polymer layer 4. Moreover, the end faces of the pigment platelets 1 can also be provided with the reflective layers 2, as shown in 1.

The polymer layer 4 consists of a plastic polymer. The polymer layer may be replaced by a glass layer or another transparent substrate which should be transparent for the excitation wavelength as well as for the emitted wavelength. It is therefore not important in the context of the invention to use a polymer layer 4, and other transparent support layers can be employed. These substrate layers do not have to be transparent for visible light, but may also be transparent for light that is not visible.

In another embodiment, the aforedescribed electrical layers may be omitted and only reflecting layers may be disposed on the end faces.

Various materials can be used as laser dyes 3 having a molecular grain size. Such dye laser systems have been realized in form of thin layer systems (DCM-doped polymer waveguides) and ASPT-doped polymer rods (J. D. Bhawalkar et al., Optics Communication 124, 1996, 33). Rhodamin 6G may also be used.

It is desirable for economic reasons to use a relatively small concentration of the laser dye particles 3 in the polymer layer. The invention, however, is not limited to this embodiment, and the laser dyes 3 may be provided as particulates, in molecular or cluster form, wherein the density of the laser dyes 3 the polymer layer 4 may vary strongly. A uniform density distribution is therefore not required for solving the object of the invention.

The present invention is not limited to the example of FIG. 1, where the dye 3 is introduced as a pigment platelet 1. Instead of the illustrated pigment platelets with two opposing reflecting layers 2, a security document which does not include these pigment platelets 1 may be used. In this case, the two reflecting layers would be directly integrated into sensitive documents in a mutually parallel spaced relationship, wherein the support layer, for example, a polymer layer, doped with laser dye molecules is arranged between the two reflecting layers. This produces a laser-active element or a laser-active region in the sensitive documents consisting of the support layer doped with the laser dye and sandwiched between the two reflecting layers. In other words, the illustration according to FIG. 1 can also be viewed as a layered document magnified by a factor ten thousand.

Accordingly, the invention is not limited to incorporating pigment platelets 1 in the various monetary and security documents in the manner shown in FIG. 1, but the monetary and security document itself may include such reflecting layers, wherein a transparent polymer layer doped with the aforedescribed molecular laser dyes is sandwiched between the reflecting layers.

Figure 2:
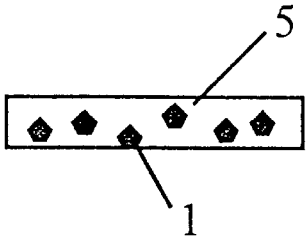
FIG. 2 shows the incorporation of such pigment platelets according to FIG. 1 into a paper.

FIG. 2 shows a paper 5, with pigment platelets according to FIG. 1 embedded and distributed in the paper. The distribution of the pigment platelets in paper 5 is identical to the distribution of the laser dyes 3 in the polymer layer 4. It is not important for solving the object of the invention that the pigment platelets are arranged in the paper in a uniform, relatively low concentration. Instead, the pigment platelets may also form clusters; they may also be distributed on the surface or they may be closely spaced. The incoming radiation may be disturbed in areas where the flakes overlap, since the pigment platelets partially covered each other and thereby attenuate the excitation radiation. This may cause interference effects which attenuate the emitted radiation. Consequently, a pigment distribution should be selected in the paper so that the pigment platelets do not overlap and interfere with each other.

Figure 3:
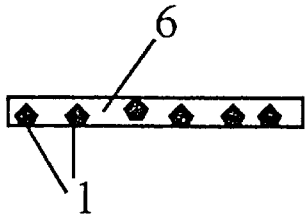
FIG. 3 shows the incorporation of such pigment platelets into a plastic foil.

FIG. 3 shows a similar arrangement with the pigment platelets 1 embedded in a plastic foil 6 which may have an arbitrary thickness.

Figure 4:
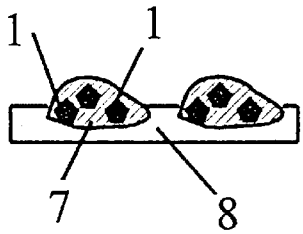
FIG. 4 shows the incorporation of such pigment platelets into an ink for printing on paper or plastic foils.

FIG. 4 shows a printing ink 7 arranged on a support 8, wherein the support 8 may be a security or sensitive document. The pigment platelets 1 are embedded in the printing ink 7. The printing ink 7 itself is preferably matched to the emission spectrum of the pigment platelets 1 so that the emitted radiation has sufficient intensity. The printing ink should be transparent for both the exciting and the emitted radiation to ensure that the pigment platelets 1 are excited.

Figure 5:
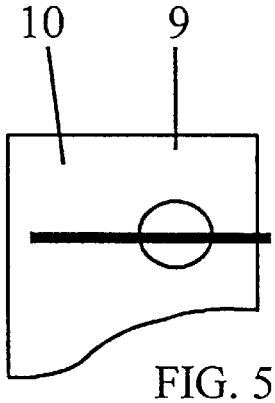
FIG. 5 and FIG. 5*a* show a laser-excitable aperture thread in a security document.
Figure 5A:
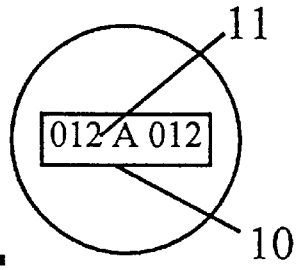

In another embodiment, FIG. 5 illustrates the integration of an aperture thread in a monetary and security document 9. The thread is an aperture thread 10 which is integrated with the monetary and security document 9 in a manner known in the art. As shown in FIG. 5*a,* the aperture thread 10 has an opening is a region of the lettering 11 and/or has indentations or recesses that are filled with the laser dye. In other words, an ink is used which is doped with the pigment platelets 1. When the aperture thread 10 is excited with suitable light, the printing ink lights up strongly, as shown in FIG. 5*a*.

Figure 6:
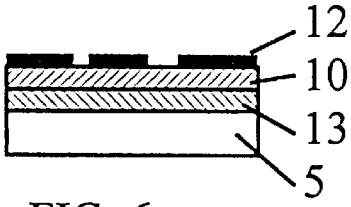
FIG. 6 is a schematical a cross-section through the document of FIG. 5.

FIG. 6 shows a cross-section through the diagram of FIG. 5. As seen from FIG. 6, an ink 13 doped with pigment platelets 1 is applied to the paper or plastic substrate 5. The metallized thread (aperture thread 10) is arranged above the substrate and has the micro-text illustrated in FIG. 5*a*. The illustrated text can also be replaced with a geometric pattern. A paper layer 12 is arranged above the just described layers and partially covers the layers, so that the surface of the aperture thread 10 is only partially visible.

Since the aperture thread has openings in the region of the lettering 11, the underlying dye 13 becomes visible through the opening. When the aperture thread 10 is excited from above, the laser dye layer 13 lights up and radiates through the openings of the aperture thread 10.

Figure 7:
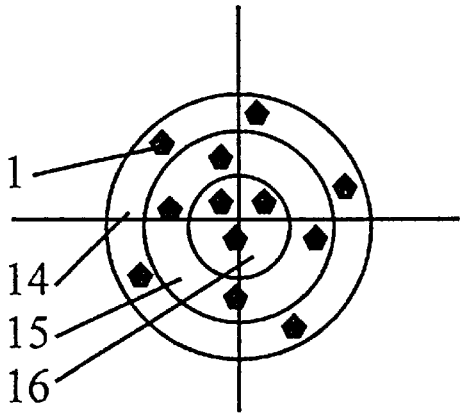
FIGS. 7 and 7*a* show a cross-section through a fiber with incorporated pigment platelets.
Figure 7A:
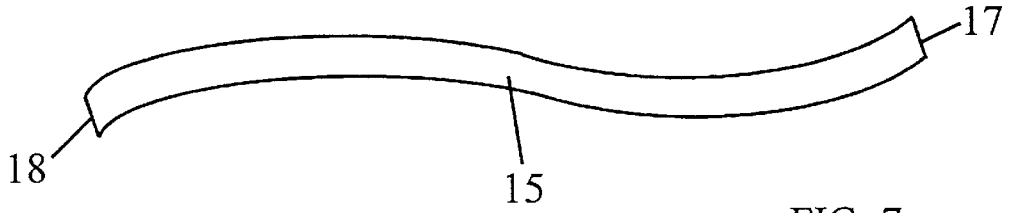

FIG. 7 shows a cross-section through the fiber 15, wherein the fiber can be a plastic thread, a textile thread, a glass thread and the like. Illustrated are different ways of introducing the pigment platelets 1 of the invention at different locations of the fiber 15. For example, if the fiber 15 has a fiber cladding 14, then the pigment platelets 1 may be arranged in the region of the fiber cladding (either alone or a combination with other fiber layers). Accordingly, a corresponding fiber cladding 14 with pigment platelets 1 can be applied. The pigment platelets 1 may also be incorporated directly in the fiber 15 or, alternatively, in a fiber cavity 16. The refractive index of the fiber cladding 14 may also be different from the refractive index of the fiber 15 itself. If, for example, a fiber cladding 14 is used that provides total reflection, then the light impinging on the outside of the fiber jacket 14 can essentially enter the fiber cladding 14 without being reflected and reach the fiber 15, thereby providing a particularly advantageous excitation of the pigment platelets 1 distributed in the fiber 15. The invention, however, is not limited to the integration of such pigment platelets 1 in a fiber 15 of this type. In another embodiment of the invention, instead of the pigment platelets, the laser dyes may be directly incorporated and distributed in the material of the fiber 15 in molecular form. Unlike the pigment platelets 1 illustrated in FIG. 7, the aforedescribed laser dyes 3 are then directly dispersed in molecular form. To ensure that the laser dyes 3 in the fiber 15 are excited at a resonance, the end faces 17, 18 of the fiber 15 may include a mirror, as illustrated in FIG. 7*a*. If such a fiber 15 is excited from the outside with a suitable radiation, then the fiber is pumped between the end faces 17, 18 throughout the fiber 15, so that the laser dyes 3 dispersed in molecular form are directly stimulated to emit light. The corresponding laser radiation is emitted at the end faces 17, 18, as is known for a fiber laser.

Figure 8:
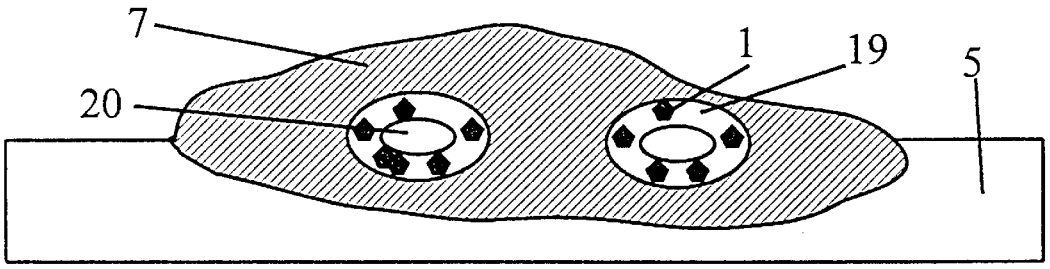
FIG. 8 is a cross-section through the upper portion of a security document with pigment platelets incorporated in the printing ink.

FIG. 8 shows the integration of a printing ink 7 on a paper 5, wherein the aforementioned pigment platelets are arranged in so-called polymer jackets 19. In other words, the pigment platelets are incorporated in a matrix, i.e., the polymer jacket 19, which acts as a micro-encapsulation for the pigment platelets which can then be advantageously integrated into the printing ink 7. It should be noted that the polymer jacket 19 can also be used as a carrier for a pigment 20 that is to be excited by electroluminescence.

This has the advantage that when the printing ink 7 is excited with a suitable laser radiation, the pigment platelets 1 are lighting up first. If, in addition, a pigment 20 that can be excited through electroluminescence is used as an additional security pigment, then additional radiation can be produced which is superimposed on the first radiation. Radiation in such pigment 20 can be excited through a corresponding electrostatic field, wherein the radiation of the pigments 20 can be superimposed on the radiation emitted by the pigment platelets 1. The laser emission of the pigment platelets 1 can also shift the wavelength of the light emitted by the pigments 20. This arrangement improves the security effect because the superimposed radiation is very difficult to duplicate.

Figure 9:
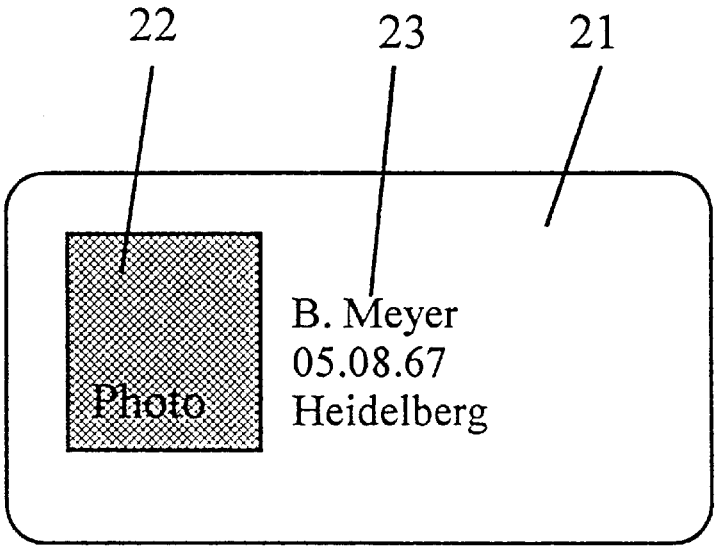
FIG. 9 is an application of the technology according to the invention with a plastic card illuminated with daylight.

FIG. 9 shows a conventional plastic card 21 which has an image area 22 for a photograph and a character field 23 and is illuminated with daylight.

Figure 10:
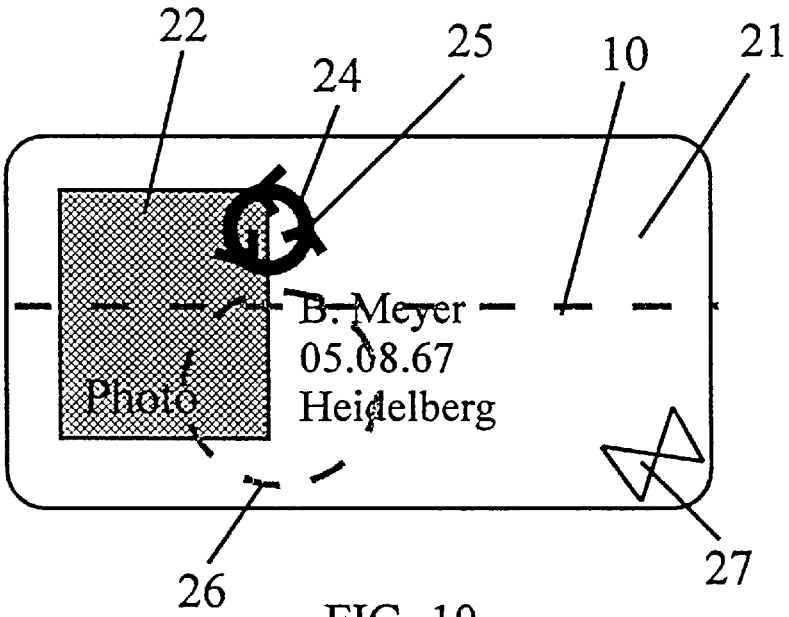
FIG. 10 the same representation as FIG. 9, but illuminated with laser light.

When the plastic card 21 is illuminated with laser light, it will have the appearance illustrated in FIG. 10. The laser light is used to excite hidden features. A first security element 24 is provided which extends across the image area 22 into the character field. In the illustrated embodiment, the first security element 24 consists of three different sector colors 25 forming complements of a circle which light up only when excited with the corresponding laser light.

Also illustrated is an aperture thread 10 which extends across the image area 22 as well as the character field 23 and the other areas of the plastic card 21. The aperture thread may also include the aforementioned micro-text and may be designed to light up. The same applies for the imprinted thread 26 which may not only include a metallized thread, but may also be imprinted and extend over the image and the character field to reveal forgeries or alterations in these areas.

Another exemplary security element 27 is shown in form of a geometric pattern which may be machine readable.

Figure 11:
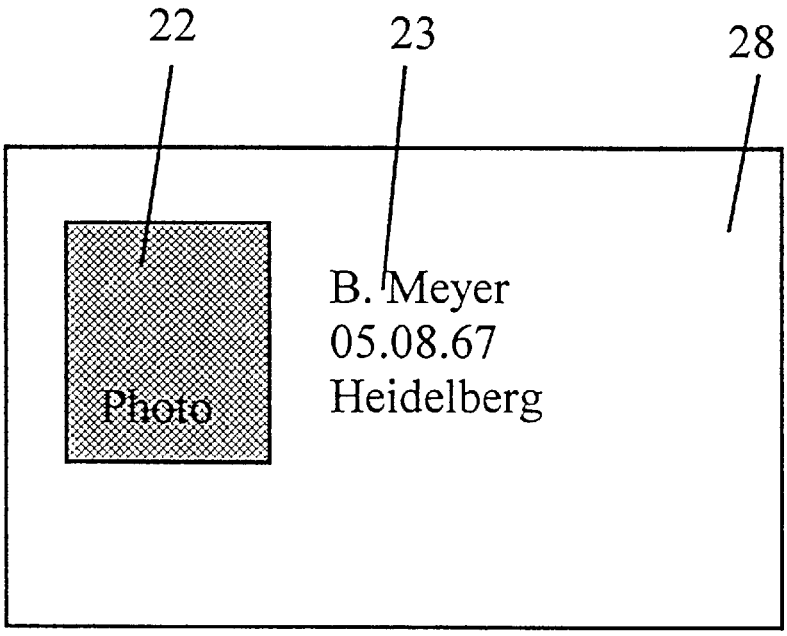
FIG. 11 is a illustration of a personnel document illuminated with daylight.
Figure 12:
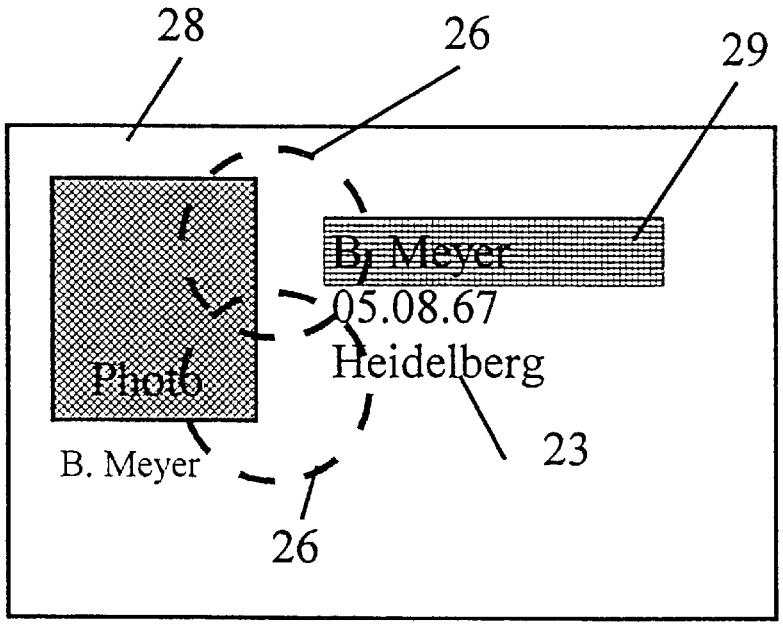
FIG. 12 is the same representation of the document illuminated with laser light.

FIGS. 11 and 12 illustrate another example of an identification document 28 having features that are covered to different degrees. The document 28 also includes an image area 22 and a character field 23. As seen in FIG. 12, two overlapping imprinted threads 26 are provided which cover the image area 22 as well as the character field 23. In another example, the name of the bearer of the identification document is provided with a light-emitting bar 29 which is covered with a printing ink having pigment platelets 1 dispersed therein.

Figure 13:
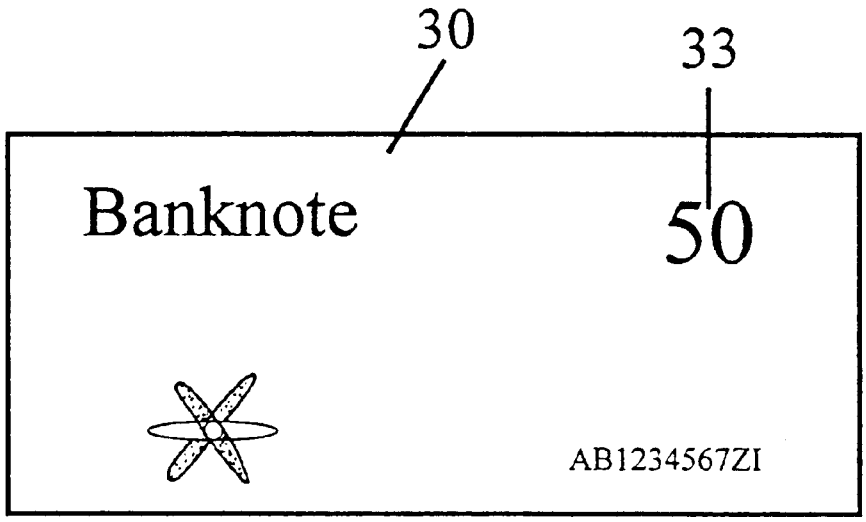
FIG. 13 is a banknote illuminated with daylight.
Figure 14:
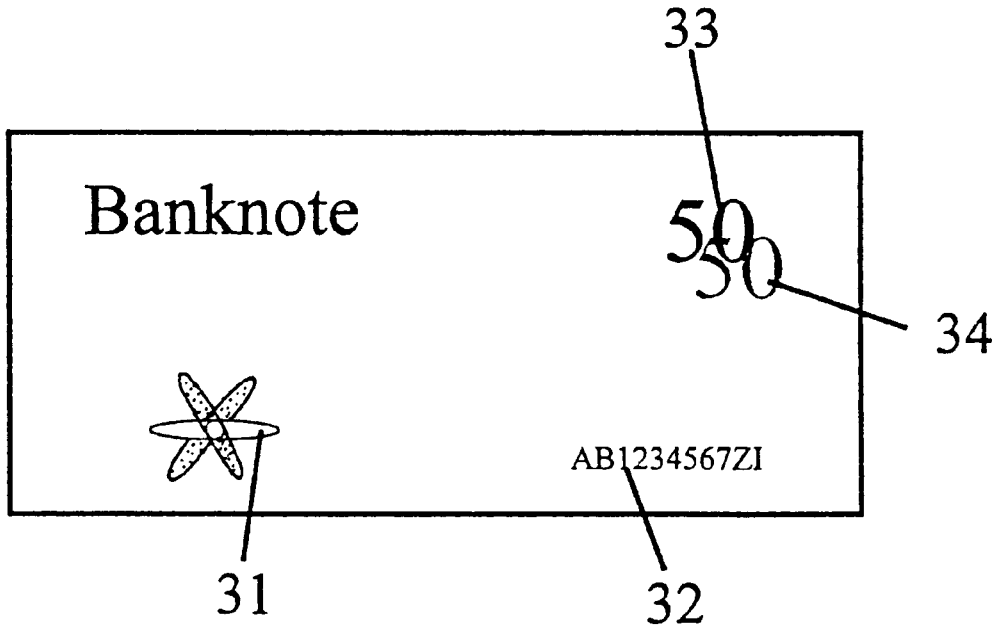
FIG. 14 is the same banknote illuminated with laser light.

In a last embodiment illustrated in FIGS. 13 and 14, a banknote 30 has a number of known features when illuminated with daylight.

When the banknote 30 is illuminated with a suitable laser for exciting the incorporated laser dyes, the security feature 31 is excited by the laser light and lights up in different colors to form a flower petal. Likewise, the number field 32 lights up in a color that is different from the color in which the number field appears in daylight. Furthermore, as also seen in FIGS. 13 and 14, the denomination field 33 is printed with two identical numbers which are displaced relative one another. The additional number field lights up when excited with a laser of the respective color and energy. This feature provides an additional security feature.

All laser dyes 3 described herein can be detected in different ways. Initially, the illustrated laser dyes fluoresce in the UV spectral range.

When the pigment platelets 1 having the laser dyes are excited, the emission spectrum exhibits sharp emission peaks as a result of the aforedescribed resonance phenomenon. Such an emission spectrum can advantageously be used for machine processing of the authentication features of such securities and sensitive documents. A number of security features can be measured and evaluated, for example, the wavelength of the emitted radiation peaks, the relative position of the peaks, their half-width, and the number and amplitude of the peaks. These parameters are dependent on the laser dyes used, the excitation energy and the materials in which the laser dyes are embedded.

It should also be pointed out that the emitted narrowband radiation can be superimposed on another emission in a manner described with respect to the embodiment of FIG. 8.

Thus, while there have been shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Substitutions of elements from one described embodiment to another are also fully intended and contemplated. It is also to be understood that the drawings are not necessarily drawn to scale but that they are merely conceptual in nature. It is the intention, therefore, to be limited only as indicated by the scope of the claims appended hereto.

What is claimed is:

1. A security document comprising at least one optically excitable dye having a first emission characteristic for authenticity checking;

a carrier material;

the at least one optically excitable dye is embedded in the carrier material and, in conjunction with the carrier material, forms a laser-active element; and wherein the at least one dye is embedded in a resonator comprising a coating of reflecting layers disposed on both sides of the carrier material containing the at least one dye.

2. A security document comprising two optically excitable dyes having each a different emission characteristic for authenticity checking;

a carrier material;

said two optically excitable dyes are each embedded in the carrier material and, in conjunction with the carrier material, form a laser-active element; and wherein the two optically excitable dyes are embedded in a resonator comprising a coating of reflecting layers disposed on both sides of the carrier material containing each of the two dyes.

3. The security document according to claim 1, wherein the resonator includes geometry and material characteristics, whereby the security document can be identified.

4. The security document according to claim 3, wherein the at least one dye is directly incorporated in a layer of the security document and the reflecting layers form part of the security document.

5. The security document according claim 4, further comprising pigment platelets including a carrier layer doped with laser dye and two mutually parallel reflecting layers disposed on both sides of the carrier layer and wherein the dyes are bedded in the pigment platelets.

6. The security document according to claim 4, wherein the at least one dye is embedded in pigment spheres including a carrier material doped with the laser dye and a reflecting layer surrounding the carrier material.

7. The security document according to claim 6, wherein the carrier material is a material that is transparent for both an exciting wavelength and an emitted wavelength.

8. The security document according to claim 7, further comprising pigment particles, and wherein the at least one dye, pigment platelets, pigment particles are microencapsulated in a materials.

9. The security document according to claim 8, wherein the at least one dye, pigment platelets and pigment particles are incorporated in color components of a printing ink.

10. The security document according to claim 9, wherein the document comprised paper and wherein the at least one dye, pigment platelets and pigment particles are incorporated in the paper.

11. The security document according to claim 9, wherein the document comprises paper having a plastic substrate and wherein the at least one dye, pigment platelets and pigment particles are incorporated in the plastic substrate.

12. The security document according to 9, wherein the document comprised paper including paper additives and wherein the at least one dye, pigment platelets and pigment particles are incorporated in the paper additives.

* * * * *